US007762443B2

(12) United States Patent
Tamura et al.

(10) Patent No.: US 7,762,443 B2
(45) Date of Patent: Jul. 27, 2010

(54) GAS COMBUSTION TYPE DRIVING TOOL

(75) Inventors: Junichi Tamura, Tokyo (JP); Katsuhiko Murayama, Tokyo (JP)

(73) Assignee: Max Co., Ltd., Chuo-ku, Tokyo (JP)

( * ) Notice: Subject to any disclaimer, the term of this patent is extended or adjusted under 35 U.S.C. 154(b) by 235 days.

(21) Appl. No.: 12/063,377

(22) PCT Filed: Aug. 7, 2006

(86) PCT No.: PCT/JP2006/315599

§ 371 (c)(1),
(2), (4) Date: Feb. 8, 2008

(87) PCT Pub. No.: WO2007/018179

PCT Pub. Date: Feb. 15, 2007

(65) Prior Publication Data

US 2009/0255973 A1 Oct. 15, 2009

(30) Foreign Application Priority Data

Aug. 9, 2005 (JP) ..... 2005-231116

(51) Int. Cl.
*B25C 1/08* (2006.01)

(52) U.S. Cl. ..... 227/10; 227/9; 227/120; 227/130

(58) Field of Classification Search ..... 227/10, 227/9, 112, 120, 130
See application file for complete search history.

(56) References Cited

U.S. PATENT DOCUMENTS 3,563,438 A 2/1971 Doyle et al.
3,967,771 A * 7/1976 Smith ..... 227/10
4,091,981 A * 5/1978 Moriguchi et al. ..... 227/8
4,736,879 A * 4/1988 Yamada et al. ..... 227/130
4,775,089 A * 10/1988 MacDonald ..... 227/2
5,193,730 A 3/1993 Tanaka et al.
5,213,247 A * 5/1993 Gschwend et al. ..... 227/10
6,116,489 A * 9/2000 Branston ..... 227/10

FOREIGN PATENT DOCUMENTS

| | | |
|---|---|---|
| CN | 2450473 | 9/2001 |
| EP | 0 726 122 A1 | 8/1996 |
| EP | 1 391 270 A1 | 2/2004 |
| EP | 1 459 850 A1 | 9/2004 |
| JP | 2-124281 | 5/1990 |
| JP | 4-28970 | 3/1992 |
| JP | 5-72380 | 10/1993 |

* cited by examiner

*Primary Examiner*—Brian D Nash
(74) *Attorney, Agent, or Firm*—Drinker Biddle & Reath LLP

(57) ABSTRACT

When gas is explosively burnt within a combustion chamber, a striking piston is impulsively driven to drive out a fastener from a nose portion. A gas tube is provided between the combustion chamber and a feed cylinder which accommodates a feed piston that reciprocally moves a feed claw engaged with and disengaged from connected fasteners to a nail feed direction for feeding to the nose portion side and an evacuation direction in opposite thereto. A check valve having a restriction hole is disposed on the way of the gas tube so as to be opened and closed. The check valve is normally urged by a spring to a closed direction and opens against the force of the spring by the gas pressure from the combustion chamber.

5 Claims, 10 Drawing Sheets

GAS COMBUSTION TYPE DRIVING TOOL

TECHNICAL FIELD

The present invention relates to a gas combustion type driving tool which includes a combustion chamber for explosively burning mixed gas obtained by mixing and stirring combustible gas and air, a striking piston cylinder mechanism driven by a pressure of burnt gas, a nose portion for slidably guiding a driver coupled to a striking piston to drive a fastener out and a feed piston cylinder mechanism for feeding a fastener to the nose portion, and in particular relates to a fastener feed mechanism for delaying the evacuation operation of a feed claw by the feed piston cylinder mechanism.

BACKGROUND ART

In some kinds of gas combustion type driving tools, combustible gas is injected into a combustion chamber sealed within a body, then mixed gas of the combustible gas and the air is stirred within the combustion chamber, and the mixed gas thus stirred is burnt within the combustion chamber to generate high-pressure combustion gas within the combustion chamber. The high-pressure combustion gas acts on a striking piston accommodated within a striking cylinder to impulsively drive the striking piston within the striking cylinder. A nail supplied to a nose portion beneath the body is driven into a steel plate or concrete by a driver coupled to the lower surface side of the striking piston. Such the combustion-gas driven driving machine is formed as a portable tool in a manner that a vessel such as a gas container filed with the combustible gas is attached within the tool and a battery acting as a power source for igniting the combustible gas is attached to the tool. Thus, the combustion-gas driven driving machine can perform the driving procedure of a nail or a pin without being restricted by a source of drive such as electric power or compressed air.

The aforesaid gas combustion type driving tool is provided with a feed mechanism for sequentially feeding connected fasteners accommodated within a magazine to a nose portion. As the feed mechanism, there is known one which is configured in a manner that the connected fasteners configured by coupling many fasters in a straight manner are accommodated within a sheath-shaped magazine, the connected fasteners are always pressed toward the nose portion side by a constant output spring, whereby immediately after a fastener supplied to an injection port within the nose portion is driven, a next fastener is supplied within the nose portion.

However, since such the straight magazines is small in the number of fastener to be accommodated therein, it is required to attach a cylindrical magazine which can house therein connected fasteners configured by coupling many fasters wound in a coil manner.

The feed piston cylinder mechanism is generally used as a feed mechanism of a fastener in the cylindrical magazine. The feed piston cylinder mechanism is configured in a manner that a feed piston accommodated within a feed cylinder so as to be slidable freely is provided with a feed claw which engages with and disengages from the connected fasteners accommodated within the magazine and the feed claw is reciprocally moved to a nail feed direction for feeding the feed claw to the nose portion side and to an evacuation direction in opposite thereto.

Thus, the cylindrical magazine together can be employed together with the feed piston cylinder mechanism. In this case, it is considered that the feed piston of the feed piston cylinder mechanism can be moved reciprocally by utilizing the pressures of a spring and the combustion gas within the combustion chamber. That is, the feed piston is fed by the spring and evacuated by the gas pressure.

However, according to the structure where the combustion chamber is directly coupled to the feed cylinder via a gas tube, the combustion gas almost simultaneously acts on the striking piston and the feed piston (feed claw). Thus, the feed piston starts the evacuation operation almost simultaneously with the striking operation of the striking piston and so a fastener becomes unstable at the time of the driving operation. That is, when the feed piston remains at the feed position by the spring, a nail at the head position supplied within the nose portion is pressed by the feed claw, whereby the posture of the fastener is stable. The posture of the fastener is preferably stable while the fastener is driven by the driver. However, when a striking mechanism operates by the pressure of the combustion gas, if the feed piston evacuates simultaneously with that the driver is driven together with the striking piston thereby to drive the fastener, a force for pressing and holding the fastener is lost and so the posture of the fastener becomes unstable. As a result, the fastener can not be surely driven with a correct posture.

Thus, in a nailing machine disclosed in JP-U-05-072380, as a means for delaying the operating timing of a feed piston, a check valve is provided at the pre-stage of a feed mechanism, whereby the gas pressure at the pre-stage of the feed piston is held and the sealing control of a gas tube is performed by an exhaust valve interlocked with a contact arm.

However, according to the aforesaid method, the exhaust valve for releasing the check valve is required and it is difficult to secure the sealing property of the valve in an environment where dust etc. likely adheres to the tip end of the nose portion.

DISCLOSURE OF THE INVENTION

One or more embodiments of the invention provide a fastener feed mechanism for a gas combustion type driving tool which can surely delay the restoring operation of a feed claw (feed piston) thereby to effectively prevent the rubbingly adhering between a driver and a fastener, with a simple structure without requiring a complicated valve mechanism and without requiring to secure the sealing property.

According to one or more embodiments of the invention, a gas combustion type driving tool is provided with: a combustion chamber which explosively burns mixed gas obtained by mixing and stirring combustible gas and air; a striking piston which is accommodated within a striking cylinder and on which the high-pressure combustion gas is acted and impulsively drive within the striking cylinder; a nose portion which slidably guides a driver coupled to the lower surface side of the striking piston thereby to drive a fastener out; and a feed piston cylinder mechanism which reciprocally moves a feed claw, that engages with and disengages from connected fasteners accommodated within a magazine, to a nail feed direction for feeding to the nose portion side and an evacuation direction in opposite thereto. A spring for normally urging a feed piston having the feed claw to the feed direction is provided at one end of the feed cylinder of the feed piston cylinder mechanism. A gas tube is provided between the combustion chamber and the other end of the feed cylinder. A check valve is provided on the way of the gas tube and a restriction hole is formed at the check valve.

According to one or more embodiments of the invention, in place of forming the restrict hole at the check valve, the feed cylinder may be opened to the atmosphere by an electromagnetic valve.

One or more embodiments of the invention are configured in a manner that the gas tube is provided between the combustion chamber and the other end of the feed cylinder and that the check valve is provided on the way of the gas tube and the restriction hole is formed at the check valve. Thus, when the driving operation completes, since the temperature within the combustion chamber reduces abruptly, the pressure at the upper space of the striking piston becomes negative and so the striking piston returns. Similarly, although the gas fed to the feed cylinder returns to the combustion chamber, since the gas returns via the restriction hole formed at the center of the check valve, it takes a long time to pass through the restriction hole and hence the pressure within the feed cylinder does not reduce rapidly. That is, since the pressure within the feed cylinder reduces gradually, the fastener feed operation of the feed piston is delayed. Thus, after the driver moves and restores to the top dead center and evacuates from the nose portion, the feed piston moves to the fastener feed direction by the force of the spring, whereby a new head fastener is supplied within the nose portion. Therefore, when the striking piston performs the fastener feed operation, since the next nail does not rubbingly adhere to the driver, the striking piston can surely restore to the top dead center.

Since the check valve is provided at the gas tube, the sealing property of the valve can be sufficiently secured even in an environment where dust etc. likely adheres.

As described above, the restoring operation of the feed claw (feed piston) can be surely delayed thereby to effectively prevent the rubbingly adhering between the driver and a fastener, with a simple structure without requiring a complicated valve mechanism and without requiring to secure the sealing property.

At the time of the driving operation, the gas pressure from the combustion chamber is supplied to the feed cylinder after the check valve is pushed and opened, and the evacuation operation of the feed piston is performed after the pressure within the feed cylinder increases sufficiently. Thus, at the time of the driving operation, since a fastener is pressed against the inner wall of the nose portion and placed in a stable state in its posture, the fastener can be driven out surely.

Further, according to one or more embodiments of the invention, by using the electromagnetic valve, since the restoring timing of the feed claw (feed piston) can be freely delayed in accordance with the temperature of the environment such as a high temperature or a low temperature, the rubbingly adhering between the driver and a fastener can be surely prevented.

Other aspects and advantages of the invention will be apparent from the following description and the appended claims.

BRIEF DESCRIPTION OF THE DRAWINGS

FIG. 7(*b*) is a diagram for explaining the feed piston cylinder mechanism.

FIG. 8(*b*) is a diagram for explaining the operation state of the gas combustion type driving tool according to the second exemplary embodiment.

EXPLANATION OF REFERENCE NUMERALS

Figure 1:
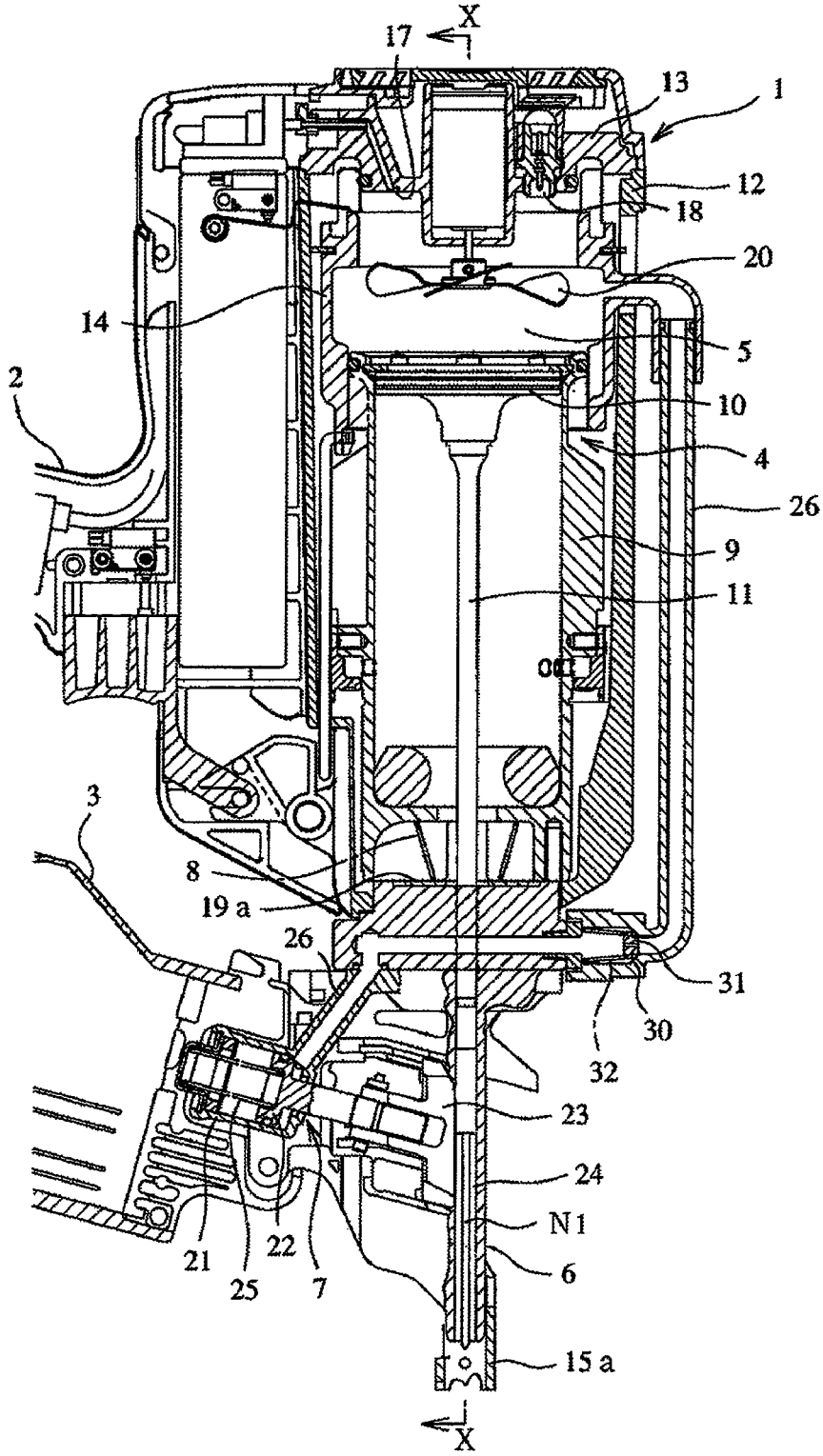
FIG. 1 is a longitudinal sectional diagram showing a main portion at the time where a gas combustion type nailing machine is not operated.

5 combustion chamber
7 feed piston cylinder mechanism
26 gas tube
31 check valve
33 restriction hole
34 electromagnetic valve

BEST MODE FOR CARRYING OUT THE INVENTION

Hereinafter, exemplary embodiments according to the invention will be explained with reference to drawings.

A gas combustion type nailing machine as an example of a gas combustion type driving tool according to the first exemplary embodiment of the invention will be explained with reference to FIG. 1 to FIG. 7(*a*).

Figure 2:
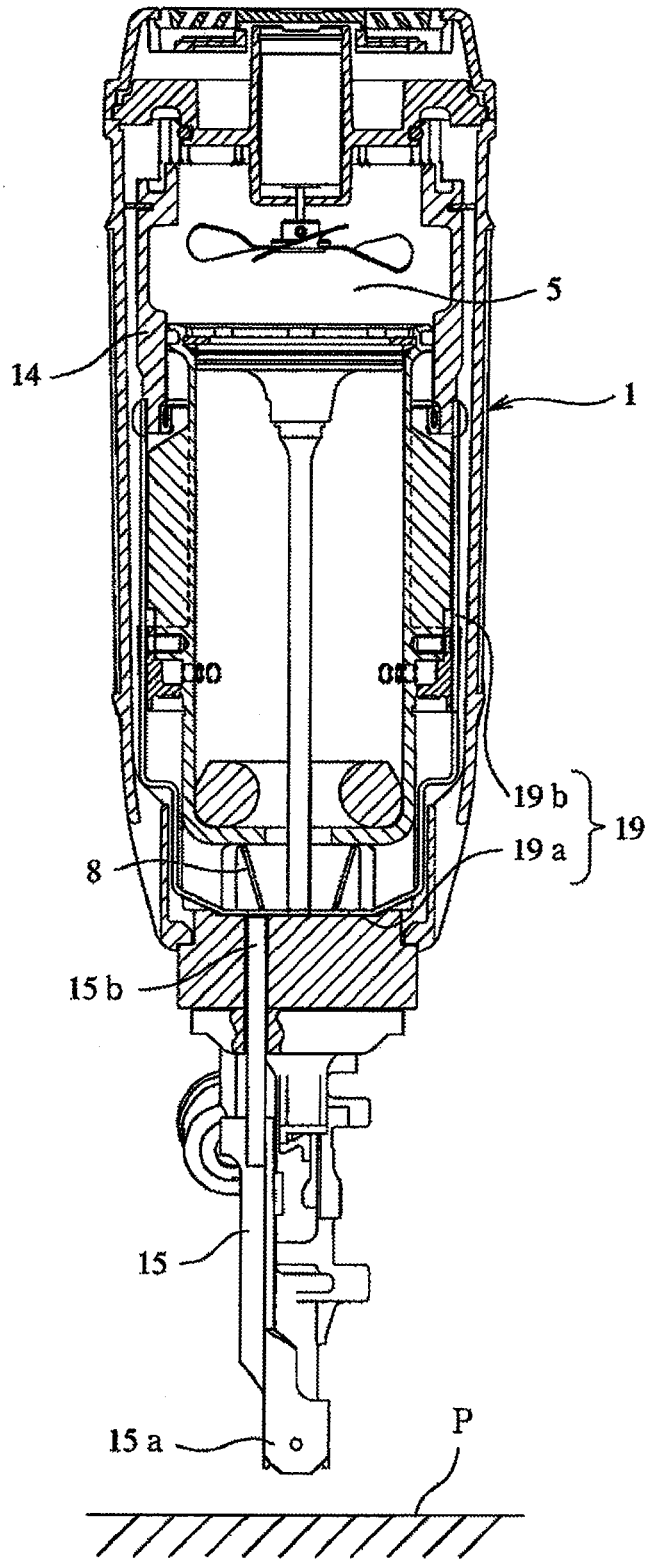
FIG. 2 is a longitudinal sectional diagram on a line X-X in FIG. 1.

In FIGS. 1 and 2, a symbol 1 depicts the body of the gas combustion type nailing machine. The body 1 is continuously provided with a grip 2 and a magazine 3, and is further provided with a striking piston cylinder mechanism 4, a combustion chamber 5, a nose portion 6 and a feed piston cylinder mechanism 7 for feeding a nail.

The striking piston cylinder mechanism 4 houses a striking piston 10 within a striking cylinder 9 so as to be slidable freely and is arranged to integrally couple a driver 11 at the lower portion of the striking piston 10.

The combustion chamber 5 is formed by the upper end surface of the striking piston 10, the striking cylinder 9, an upper wall (cylinder head) 13 formed at the inside of an upper housing 12, and an annular movable sleeve 14 disposed therebetween. The combustion chamber 5 is configured in a manner that the combustion chamber in a sealed state is formed when the movable sleeve 14 is moved upward, whilst the upper portion of the combustion chamber 5 communicates with the atmosphere when the movable sleeve is moved downward.

The movable sleeve 14 links with a contact arm 15 via a link member 19. The link member 19 is configured in a manner that an link portion 19*b* is extended along the outer periphery of the striking cylinder 9 from the end portion of a basket-shaped bottom portion 19*a* disposed at the beneath of the striking cylinder 9. The upper end of the link portion 19*b* is coupled to the movable sleeve 14 and the link portion 19*b* is urged downward by a spring 8 provided between the basket shaped bottom portion and the lower surface of the striking cylinder 9. The contact arm 15 is provided so as to freely slide elevationally along the nose portion 6. The lower end 15*a* of the contact arm protrudes from the nose portion 6. When the lower end 15*a* is pushed against a material P to be driven together with the nose portion 6, the lower end moves upward relatively with respect to the nose portion 6. The lower surface of the basket-shaped bottom portion 19*a* of the link member 19 engages with the upper end 15*b* of the contact arm 15.

Within the upper housing 12, there are disposed an injection nozzle 17 communicating with a gas vessel and an ignition plug 18 for igniting and burning mixed gas. Further, at the upper housing 12, there is provided with a rotary fan 20 for stirring and mixing combustible gas injected within the combustion chamber 5 with the air within the combustion chamber 5 to generate mixed gas of a predetermined air-fuel ratio within the combustion chamber 5.

The nose portion 6 guides the sliding operation of the driver 11 and opens to the magazine 3.

Figure 7A:
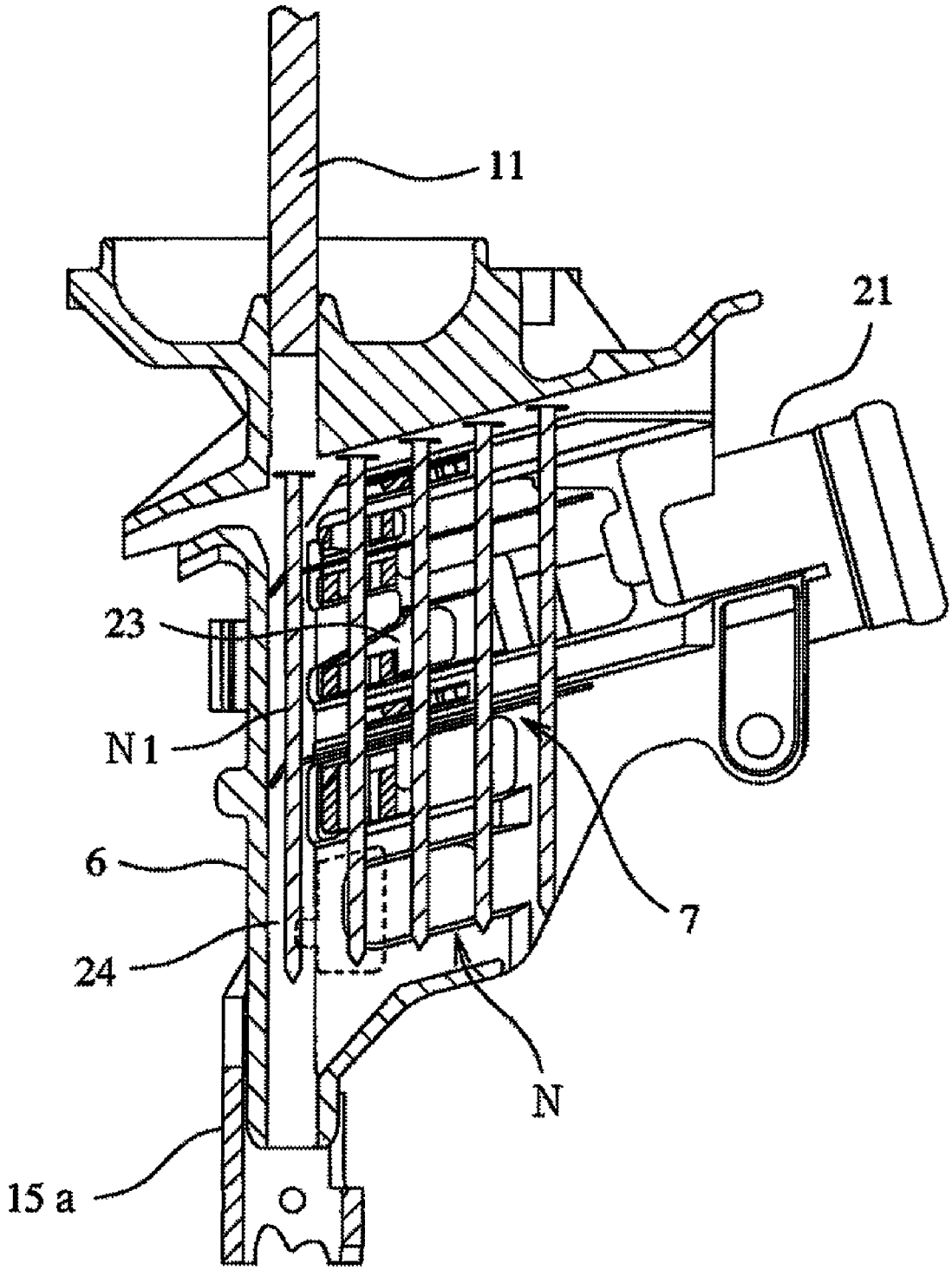
FIG. 7(*a*) is a diagram for explaining a feed piston cylinder mechanism.
Figure 7B:
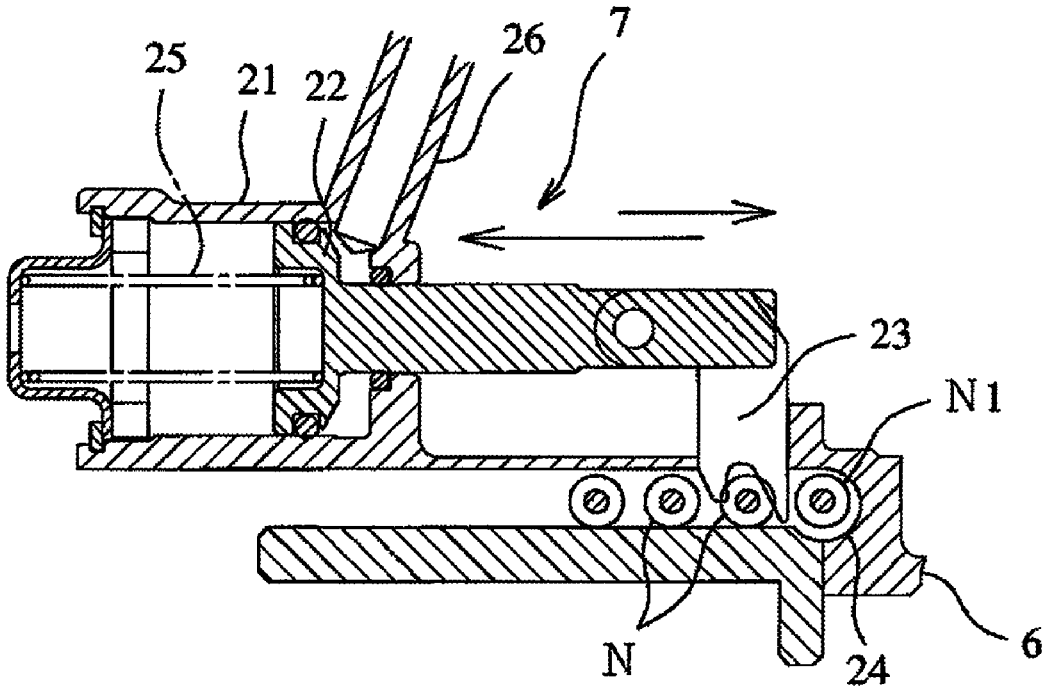

As shown in FIGS. 7(*a*) and 7(*b*), the feed piston cylinder mechanism 7 is arranged to couple a feed piston 22 accommodated within a feed cylinder 21 so as to be slidable freely with a feed claw 23, and to make the feed claw 23 together with the feed piston 22 engage with and disengage from connected nails N accommodated within the magazine 3 thereby to reciprocally move the feed piston and the feed claw to a nail feed direction for feeding to the nose portion 6 side and to an evacuation direction in opposite thereto. When the feed piston 22 moves to the moving end of the feed direction, a head nail N1 at the head position of the connected nails N is pushed into the injection port 24 of the nose portion 6. Thus, in a state where the feed piston 22 is located at the moving end position of the feed direction, since the connected nails N also do not move, the head nail N1 is held within the injection port 24.

A spring 25 for normally urging the feed piston 22 to the feed piston feeding direction is provided at the feed cylinder 21 of the feed piston cylinder mechanism 7. In contrast, an opening portion is formed at the opposite side of the spring 25 of the feed cylinder 21. The opening portion communicates with the combustion chamber via a gas tube 26.

Figure 3:
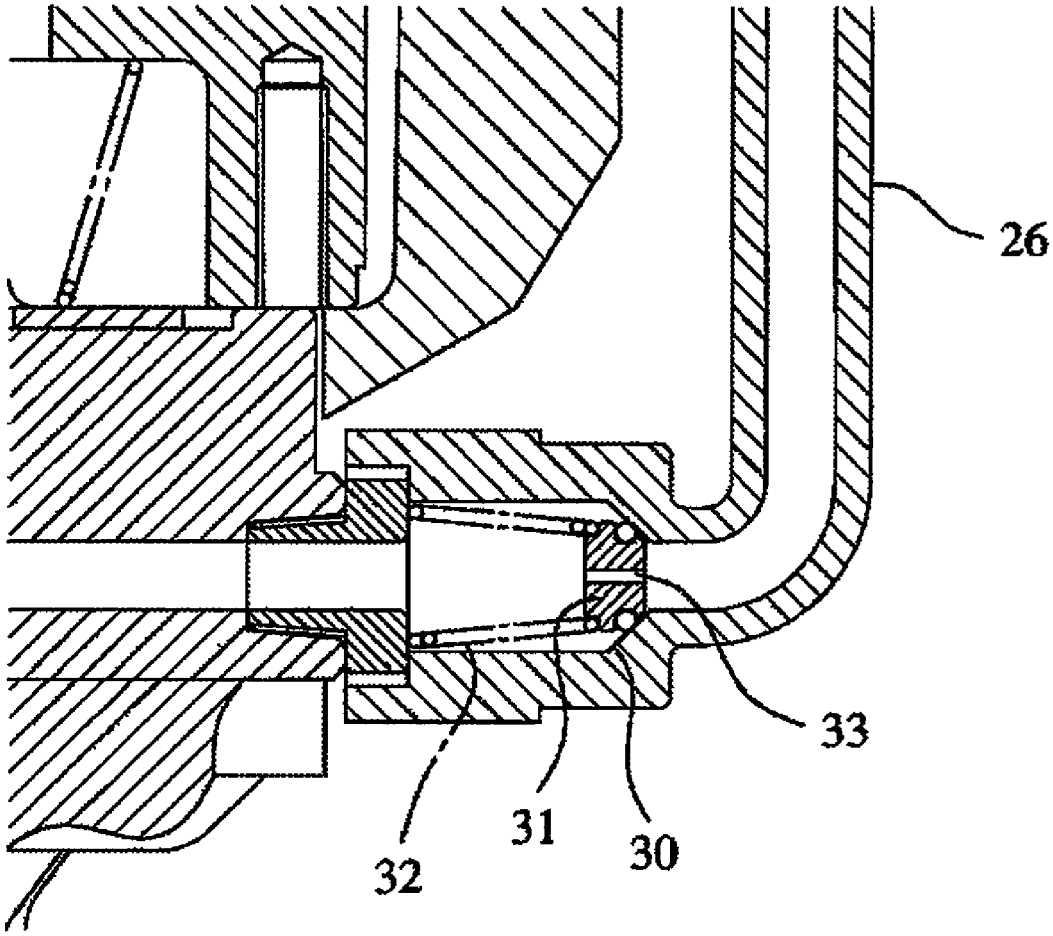
FIG. 3 is an enlarged diagram of a check valve portion.

As shown in detain in FIG. 3, a valve port 30 is formed on the way of the gas tube 26 and a check valve 31 is disposed within the valve port. The check valve 31 is configured in a manner that it is normally urged by a spring 32 so as to move to the combustion chamber side thereby to close the valve port 30 and opens the valve port 30 when the check valve is operated against the spring 32 by the gas pressure from the combustion chamber 5.

At the center portion of the check valve 31, there is formed a restriction hole 33 of a small diameter serving as an exhaust mechanism which discharges gas supplied within the feed cylinder from the feed cylinder.

Figure 4:
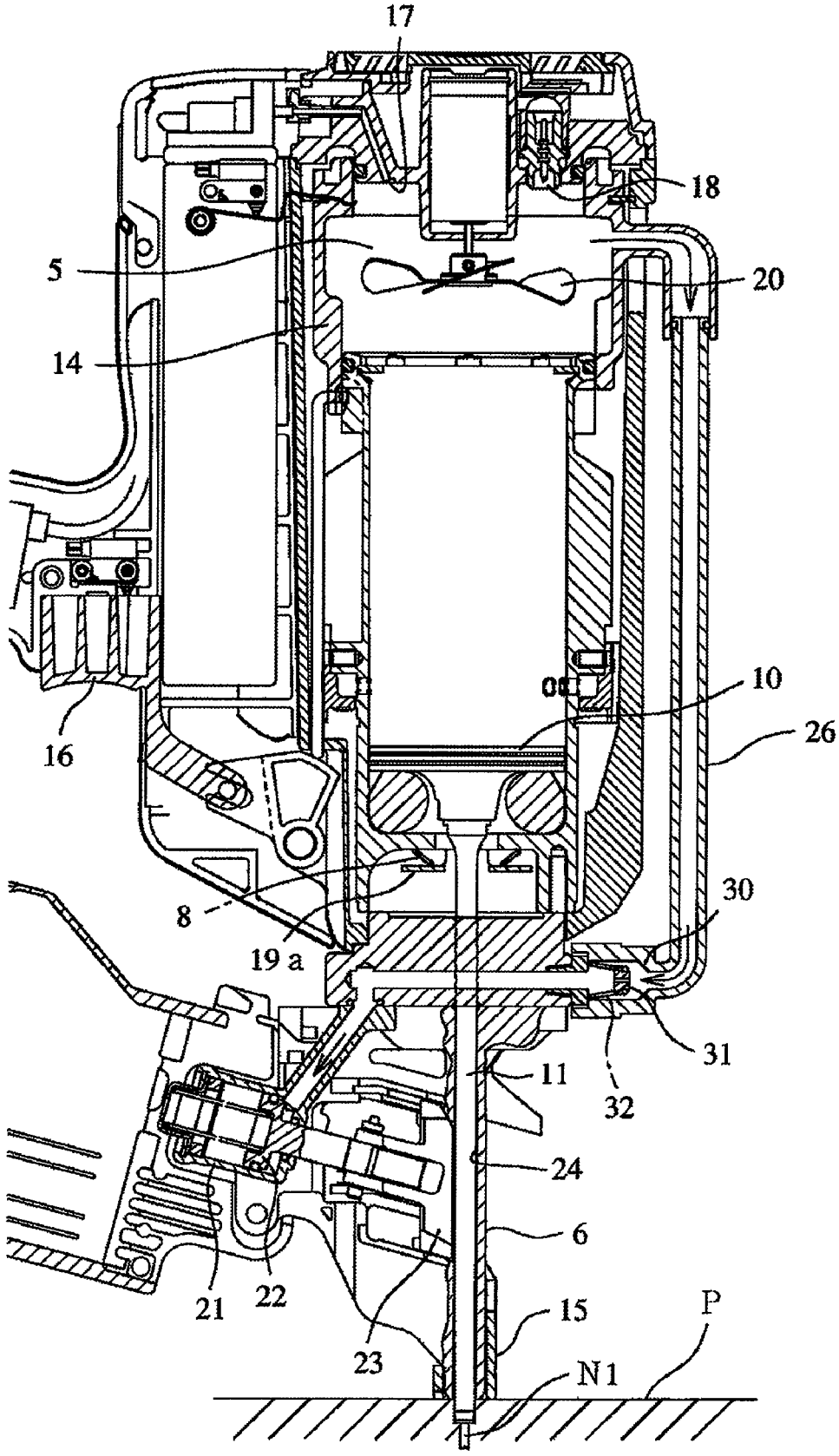
FIG. 4 is a longitudinal sectional diagram showing a state at the time of starting the driving operation of the nailing machine.
Figure 5:
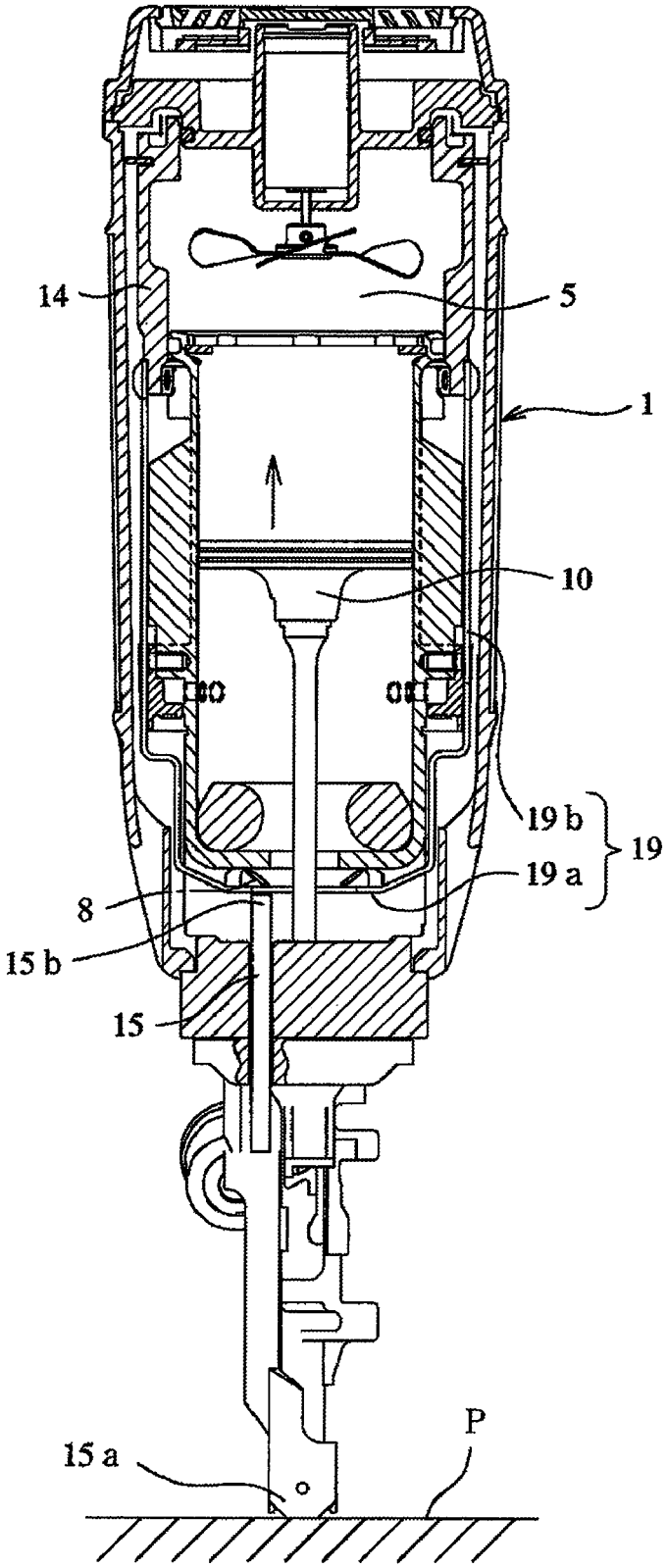
FIG. 5 is a longitudinal sectional diagram showing a state at the time of starting the driving operation, with the same section as FIG. 2.

Next, the operation mode of an operation delay mechanism will be explained. First, as shown in FIGS. 4 and 5, at the time of driving a nail, the nose portion 6 is strongly pushed against the driven material P to relatively move the contact arm 15 up, whereby the movable sleeve 14 also moves upward to form the sealed combustion chamber 5. Further, the combustible gas is injected into the combustion chamber 5 from the injection nozzle 17 and the rotary fan 20 rotates to stir and mix the combustible gas and the air. Then, when a trigger 16 is pulled, the ignition plug 18 ignites the mixed gas and so the mixed gas is burnt and explosively expands. The pressure of the combustion gas acts on the upper surface of the striking piston 10 to drive the striking piston downward, so that the driver 11 strikes the head nail N1 supplied within the injection port 24 of the nose portion 6 to drive the head nail within the driven material P.

Simultaneously, since the combustion gas within the combustion chamber 5 passes through the gas tube 26, the check valve 31 is pushed out against the spring 32 by the gas pressure thereby to open the valve port 30. Thus, since the gas is further supplied to the feed cylinder 21 via the valve port, the feed piston 22 moves to the evacuation direction.

That is, the gas pressure is supplied to the feed cylinder 21 from the combustion chamber 5 after the check valve 31 in a closed state by the spring 32 is pushed and opened. Further, the feed piston 22 performs the evacuation operation after the gas pressure increases to a value sufficient for evacuating the feed piston 22. Thus, the evacuation operation can be delayed by a time period necessary for reaching the sufficient gas pressure.

In this manner, the striking piston 10 is driven in accordance with the combustion of the combustion chamber 5 and thereafter the feed piston 22 performs the evacuation operation. Thus, since the feed claw 23 of the feed piston 22 does not operate until the head nail N1 within the nose portion 6 is driven out by the driver 11 due to the driving operation of the striking piston 10, the head nail is pushed into the injection port 24 of the nose portion 6 and placed in a stable state of the posture, so that the head nail can be driven out surely with the correct posture.

Figure 6:
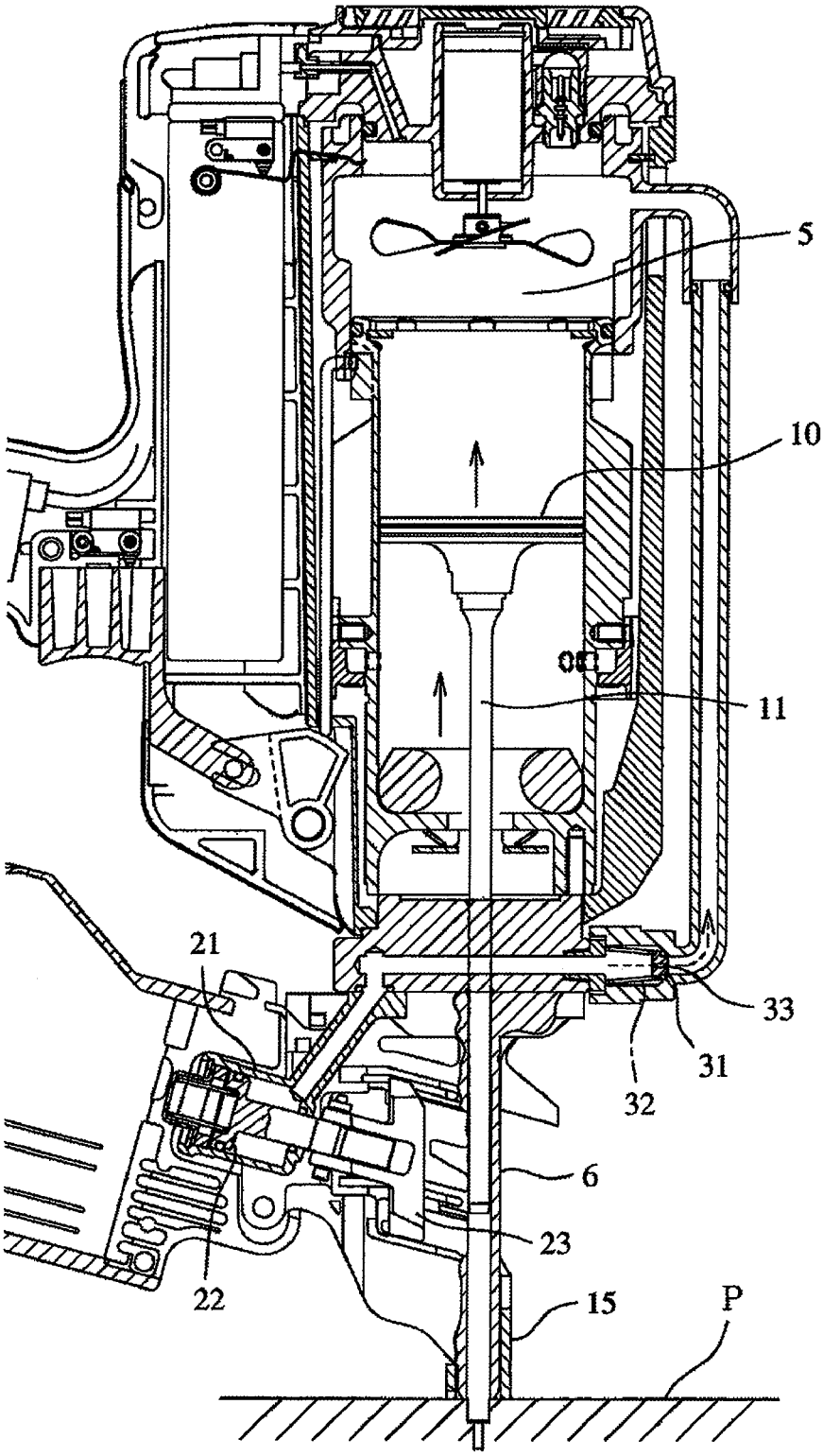
FIG. 6 is a longitudinal sectional diagram showing a state immediately after starting the driving operation.

When the driving operation completes, since the temperature within the combustion chamber 5 reduces abruptly, the pressure at the upper space of the striking piston 10 expanded to the striking cylinder 9 becomes negative. Thus, since the volume at the upper space tends to return to the original value due to the pressure difference between the upper space and the atmosphere from the lower direction, the striking piston 10 returns to the top dead center as shown in FIG. 6. Similarly, since the gas fed to the feed cylinder 21 also tends to return to the combustion chamber 5, the check valve 31 is closed by the spring 32. Thus, although the gas returns via the restriction hole 33 formed at the center of the check valve 31, since it takes a long time to pass through the restriction hole 33, the pressure within the feed cylinder 21 does not reduce rapidly. That is, since the pressure within the feed cylinder reduces gradually, the nail feed operation of the feed piston 22 is delayed. Thus, after the driver 11 moves and restores to the top dead center and evacuates from the nose portion 6, the feed piston moves and restores to the nail feed direction as shown in FIG. 1, whereby a new head nail is supplied within the nose portion 6. Therefore, when the striking piston 10 moves and restores to the original position, since the next nail does not rubbingly adhere to the driver 11, the striking piston can surely restore to the top dead center.

Since the gas tube 26 supplies the pressure of the combustion gas burnt within the combustion chamber 5 (at the upper portion of the driving piston) to the feed piston cylinder mechanism, a sufficiently high pressure can be supplied thereto.

Figure 8A:
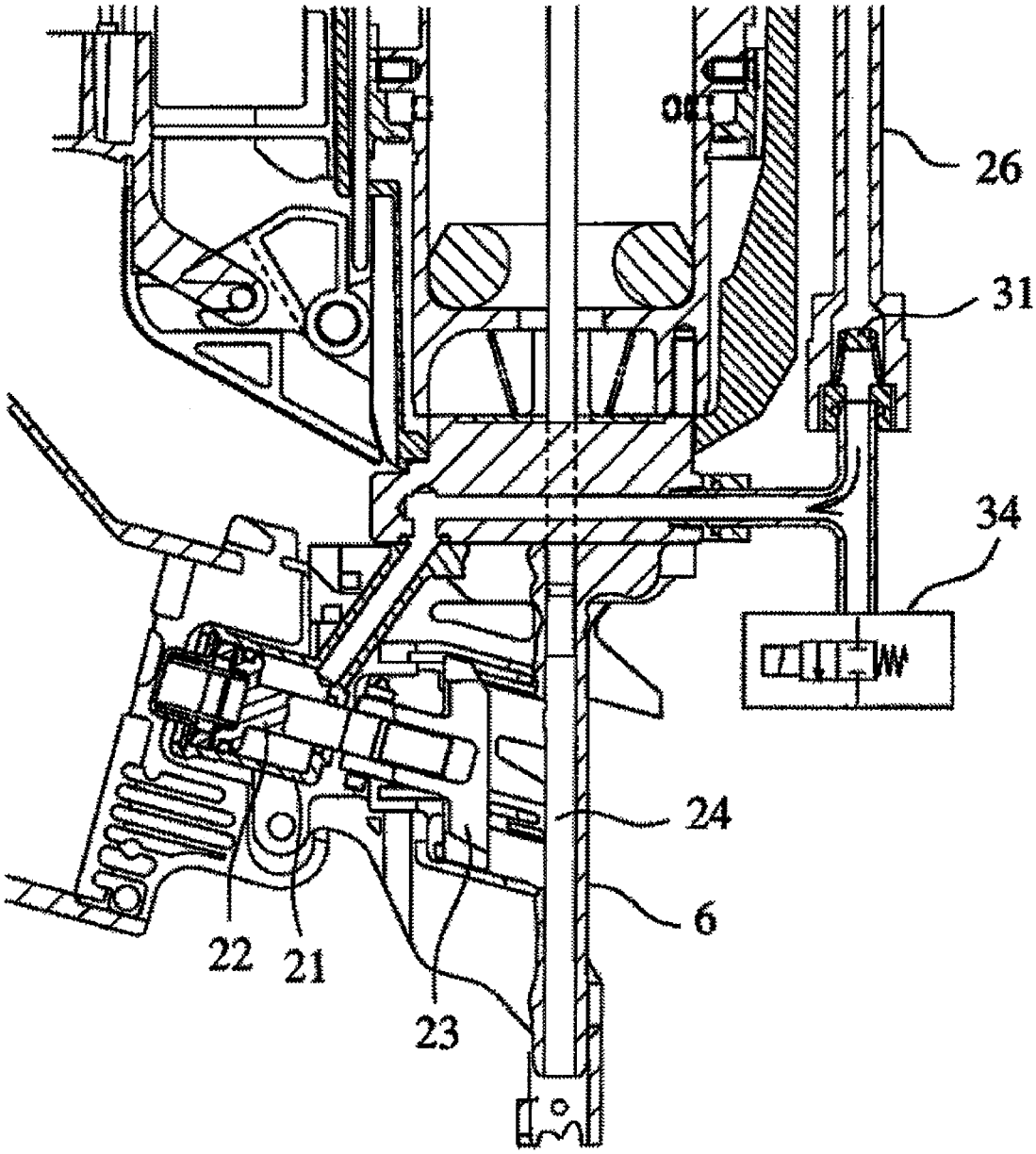
FIG. 8(*a*) is a diagram for explaining the operation state of a gas combustion type driving tool according to a second exemplary embodiment.
Figure 8B:
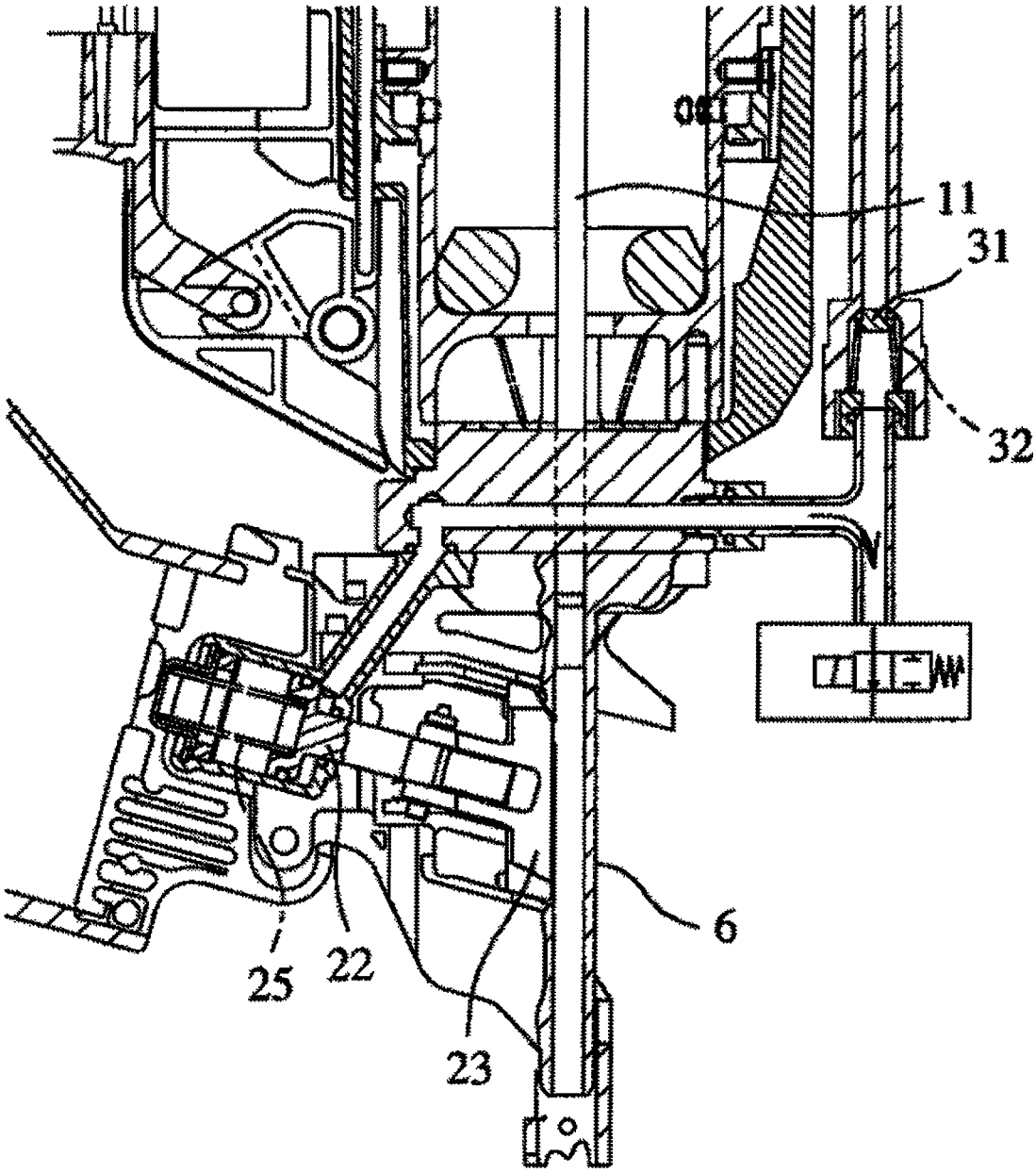

FIGS. 8(*a*) and 8(*b*) shows a main portion of the second exemplary embodiment of the invention. FIG. 8(*a*) shows a configuration in which, in place of forming the restrict hole at the check valve 31, an electromagnetic valve 34 is disposed between the check valve 31 of the gas tube 26 and the feed cylinder 21 as the exhaust mechanism which discharges gas supplied within the feed cylinder from the feed cylinder. The electromagnetic valve 34 is set to be opened after the check valve 31 closes after the completion of the driving operation. According to the aforesaid configuration where the feed cylinder 21 is opened to the atmosphere by the electromagnetic valve 34, at the time of the driving, like the aforesaid embodiment, the gas pressure is supplied to the feed cylinder 21 from the combustion chamber 5 after the check valve 31 is opened as shown above thereby to evacuate the feed piston 22 (feed claw 23). Thus, a head nail can be surely driven out with the correct posture where the head nail is pushed into the injection port 24 of the nose portion 6 and placed in a stable state of the posture.

When the driving operation completes, since the temperature within the combustion chamber 5 reduces abruptly, the striking piston returns to the top dead center. Similarly, since the gas fed to the feed cylinder 21 also tends to return to the combustion chamber, the check valve 31 is closed by the spring 32. After the driver 11 moves and restores to the top dead center and evacuates from the nose portion 6, the electromagnetic valve 34 opens as shown in FIG. 8(*b*) thereby to exhaust the compressed air within the feed cylinder. Thus, the feed piston 22 moves and restores to the nail feed direction by the force of the spring 25, and a new head nail is supplied within the nose portion 6. Therefore, when the striking piston moves and restores, since the next nail does not rubbingly adhere to the driver 11, the striking piston can surely restore to the top dead center.

In this manner, by using the electromagnetic valve 34, since the restoring timing of the feed claw (feed piston) can be freely delayed in accordance with the temperature of the environment such as a high temperature or a low temperature, the rubbingly adhering between the driver 11 and a nail can be surely prevented.

The driving tool according to the invention is not limited to the nailing machine and can be applied to a driving tool where a power is transmitted by the combustion thereby to feed a fastener such as connected rod members having head portions (nails, screws) or connected rod members having no head portions (parallel pins).

Although the invention has been explained in detail as to the particular embodiments, it would be apparent for those skilled in the art that various modifications and variations may be made without departing from spirit or scope of the invention.

The present application is based on Japanese Patent Application (Japanese Patent Appln. No. 2005-231116) filed on Aug. 9, 2005, the contents of which is incorporated herein by reference.

INDUSTRIAL APPLICABILITY

The invention can be utilized for a gas combustion type driving tool which includes a combustion chamber for explosively burning mixed gas obtained by mixing and stirring combustible gas and air, a striking piston cylinder mechanism driven by the pressure of burnt gas, a nose portion for slidably guiding a driver coupled to a striking piston to drive a fastener out and a feed piston cylinder mechanism for feeding a fastener to the nose portion.

The invention claimed is:

1. A gas combustion type driving tool, comprising:

a combustion chamber;

a striking cylinder;

a striking piston accommodated within the striking cylinder and driven by high-pressure combustion gas;

a driver that is coupled to the striking piston and drives a fastener;

a nose portion that slidably guides the driver;

a feed piston cylinder mechanism that reciprocally moves a feed claw, that is engaged with and disengaged from connected fasteners accommodated within a magazine, to a nail feed direction for feeding to a side of the nose portion and an evacuation direction in opposite thereto;

a spring that is provided at one end of a feed cylinder of the feed piston cylinder mechanism and normally urges a feed piston having the feed claw to the feed direction;

a gas tube that couples the combustion chamber with the other end of the feed cylinder;

a check valve that is provided at the gas tube; and an exhaust mechanism that exhausts gas supplied within the feed cylinder from the feed cylinder.

2. The gas combustion type driving tool according to claim 1, wherein the exhaust mechanism includes a restriction hole provided at the check valve.

3. The gas combustion type driving tool according to claim 2, wherein in a state where the check valve is closed, the gas within the feed cylinder is returned to a side of the combustion chamber via the restriction hole and a pressure within the feed cylinder is gradually reduced.

4. The gas combustion type driving tool according to claim 1, wherein the exhaust mechanism includes an electromagnetic valve and the feed cylinder is opened to atmosphere via the electromagnetic valve.

5. The gas combustion type driving tool according to claim 4, wherein the electromagnetic valve is opened after the driver moves and restores to a top dead center.

* * * * *